US007134547B2

(12) United States Patent
Auclair

(10) Patent No.: US 7,134,547 B2
(45) Date of Patent: Nov. 14, 2006

(54) BASKET CARRIER FOR BOTTLES AND BLANK THEREFOR

(75) Inventor: Jean-Michel Auclair, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 172 days.

(21) Appl. No.: 10/649,550

(22) Filed: Aug. 27, 2003

(65) Prior Publication Data

US 2004/0094435 A1 May 20, 2004

Related U.S. Application Data

(63) Continuation of application No. PCT/US02/06337, filed on Feb. 27, 2002.

(51) Int. Cl.
*B65D 75/00* (2006.01)

(52) U.S. Cl. ..... 206/143; 206/196; 206/434

(58) Field of Classification Search ..... 206/143, 206/193, 194, 196, 199, 200, 427, 429, 434; 229/120.08, 120.24, 120.26, 120.32
See application file for complete search history.

(56) References Cited

U.S. PATENT DOCUMENTS

| | | | | |
|---|---|---|---|---|
| 2,772,020 A | | 11/1956 | Kramer | |
| 3,011,677 A | | 12/1961 | Struble | |
| 3,411,663 A | | 11/1968 | Moore, et al. | |
| 3,860,113 A | | 1/1975 | Helms | |
| 4,217,983 A | | 8/1980 | Stout | |
| 4,243,138 A | * | 1/1981 | Wilson | 206/188 |
| 5,400,901 A | | 3/1995 | Harrelson | |
| 5,680,930 A | | 10/1997 | Stone | |
| 6,189,687 B1 | | 2/2001 | Bakx | |
| 6,571,941 B1 | | 6/2003 | Holley, Jr. | |
| 6,598,739 B1 | * | 7/2003 | Collura | 206/185 |

FOREIGN PATENT DOCUMENTS

| | | |
|---|---|---|
| EP | 0 720 572 B1 | 1/1998 |
| GB | 2 201 950 A | 9/1988 |
| GB | 2 381 260 A | 4/2003 |
| WO | 95/34483 A1 | 12/1995 |
| WO | 00/51893 A2 | 8/2000 |

* cited by examiner

*Primary Examiner*—Shian T. Luong
(74) *Attorney, Agent, or Firm*—Tsugihiko Suzuki

(57) ABSTRACT

An article carrier of the basket type adapted to accommodate a plurality of articles, such as bottles, comprises a base, opposed side and end walls, and a medial partition structure. The bottles are received on both the sides of the medial partition structure. A securing flap is hinged to the medial partition structure and is secured to one end wall to create a joint between said medial partition structure and that end wall. The medial partition structure includes first and second medial panels hinged together along a first fold line. The first fold line is disposed inwardly of the carrier from the one end wall relative to a second fold line by which the securing flap is hinged to one of the first and second medial panels.

18 Claims, 12 Drawing Sheets

BASKET CARRIER FOR BOTTLES AND BLANK THEREFOR

This is a continuation of international application No. PCT/US02/06337, filed Feb. 27, 2002, which is hereby incorporated by reference.

BACKGROUND OF THE INVENTION

This invention relates to an article carrier of the basket type formed from paperboard which carrier is adapted to accommodate a plurality of articles, for example bottles, and to a blank for forming the carrier.

Normally a basket carrier for bottles includes a central (medial) partition structure which incorporates a handle structure by which the carrier can be lifted and carried and the bottles are arranged in rows on either side of the central partition structure. More often than not, the bottles are separated from one another by transverse partition panels extending from each side of the medial partition structure to the adjacent side wall of the carrier. Hence in this type of arrangement the bottles are accommodated in individual cells of the carrier although such cells are not always essential.

SUMMARY OF THE INVENTION

In the present invention, a new internal partition structure is provided which gives savings in the amount of paperboard used in the construction of the carrier, but also provides a rigid internal partition structure.

One aspect of the invention provides an article carrier of the basket type adapted to accommodate a plurality of articles, such as bottles, comprising a base, opposed side and end walls, an internal medial partition structure and handle means by which the carrier can be lifted and carried. The articles are receivable on both sides of said medial partition structure of the carrier. A securing flap hinged to the medial partition structure is secured to an end wall of the carrier to create a joint between said medial partition structure and that end wall. The medial partition structure is formed from first and second medial partition panels hinged together along a first fold line, wherein the first fold line is disposed inwardly of the carrier from the end wall relative to a second fold line by which said securing flap is hinged to one of the first and second medial partition panels. In some constructions, the first fold line may be disposed between opposed end edges of the said one of the pair of medial panels and the second fold line is disposed along one of the opposed end edges of that said one medial partition panel. Preferably, the first and second fold lines are disposed in parallel with one another.

According to an optional feature of this aspect of the invention, the first and second medial panels each provides a transverse partition strip for connecting the medial structure to the side walls.

Preferably, the first fold line may be disposed between opposed end edges of the said one of the pair of medial panels and the second fold line is disposed along one of the opposed end edges of that said one medial partition panel. Preferably, the first and second fold lines are disposed in parallel with one another.

According to another optional feature of this aspect of the invention, the securing flap is hinged to an end wall panel of the carrier.

More preferably, the first medial panel is a full-length panel extending between opposed carrier end wall and the second medial panel is shorter in length than the second medial panel.

A second aspect of the invention provides a blank for forming an article carrier of the basket type, which blank comprises a series of main panels hinged one to the next for forming the side panels, and the end panels of the carrier, a base and a handle structure. The blank includes at one end thereof panels to form a medial partition structure of the carrier. The panels comprising a first medial partition panel from which is struck transverse partition panel means to be secured to one side wall of the carrier and a securing flap hinged to one end of the first medial partition panel, a second medial partition panel from which is struck transverse partition panel means to be secured to the other side wall of the carrier. The first and second medial partition panels are hinged together and the second medial partition panel and its transverse partition panel means is partially struck from the first medial partition panel. The medial partition structure is formed from first and second medial partition panels hinged together along a first fold line and wherein the first fold line is disposed inwardly of the carrier from said end wall relative to a second fold line by which said securing flap is hinged to one of the first and second medial partition panels.

Preferably, the first fold line is disposed between opposed end edges of the said one of the first and second medial panels and the second fold line is disposed along one of the opposed end edges of that said one medial partition panel. More preferably, the first and second fold lines are disposed in parallel with one another.

According to an optional feature of the second aspect of the invention the first and second medial panels may each provides a transverse partition strip for connecting the medial structure to the side walls.

According to another optional feature of the second aspect of the invention, the securing flap may be hinged to an end wall of the blank.

Optionally, the first medial panel may be a full length panel extending between opposed end wall and the second medial panel is shorter in height than the first medial panel.

BRIEF DESCRIPTION OF THE DRAWINGS

Exemplary embodiments of the invention will now be described, by way of example only, with reference to the accompanying drawings, in which.

DETAILED DESCRIPTION OF THE PREFERRED EMBODIMENTS

Figure 1:
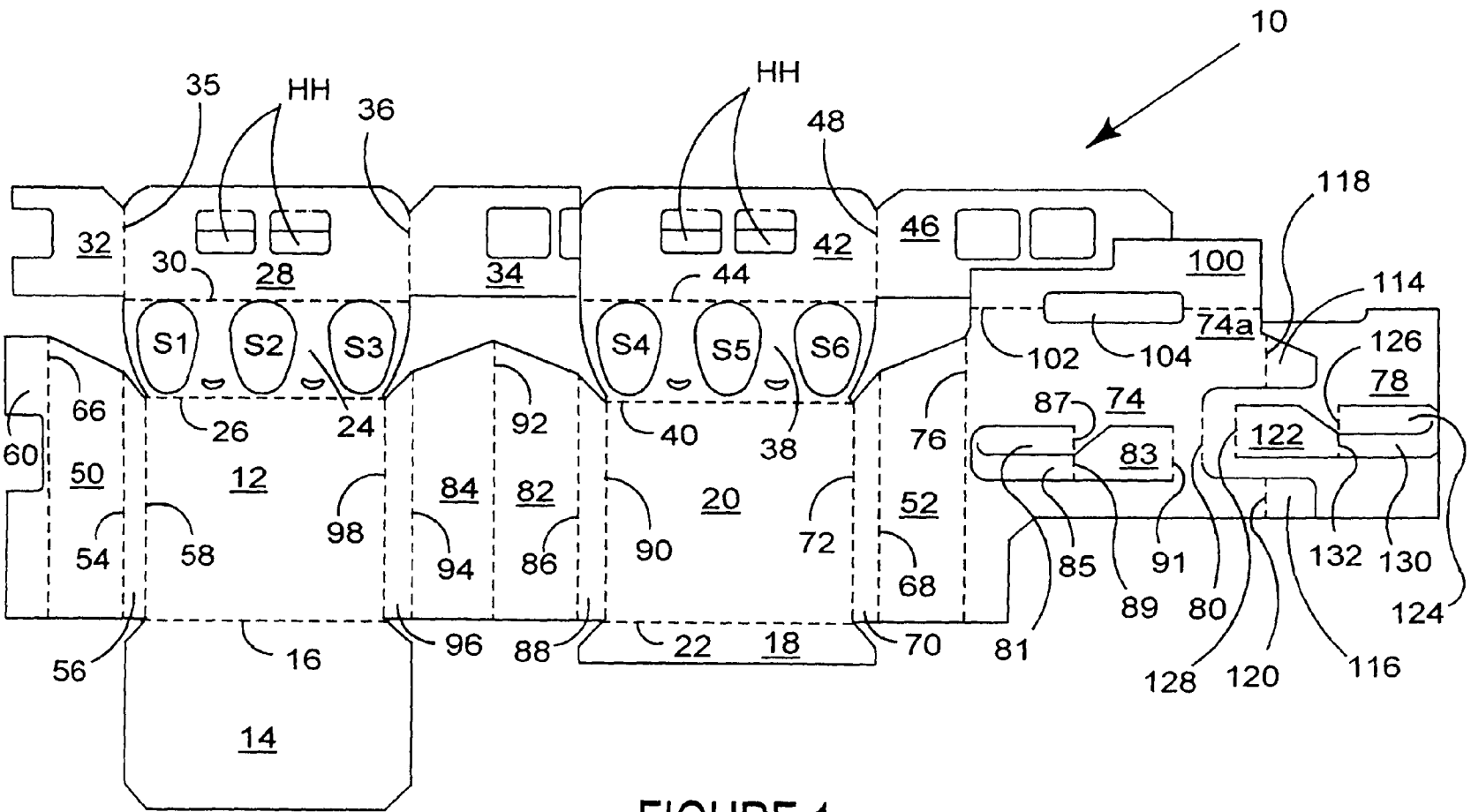
FIGS. 1 and 2 are plan views of an unfolded single blank of paperboard from which a bottle carrier according to one embodiment of the invention is formed.
Figure 2:
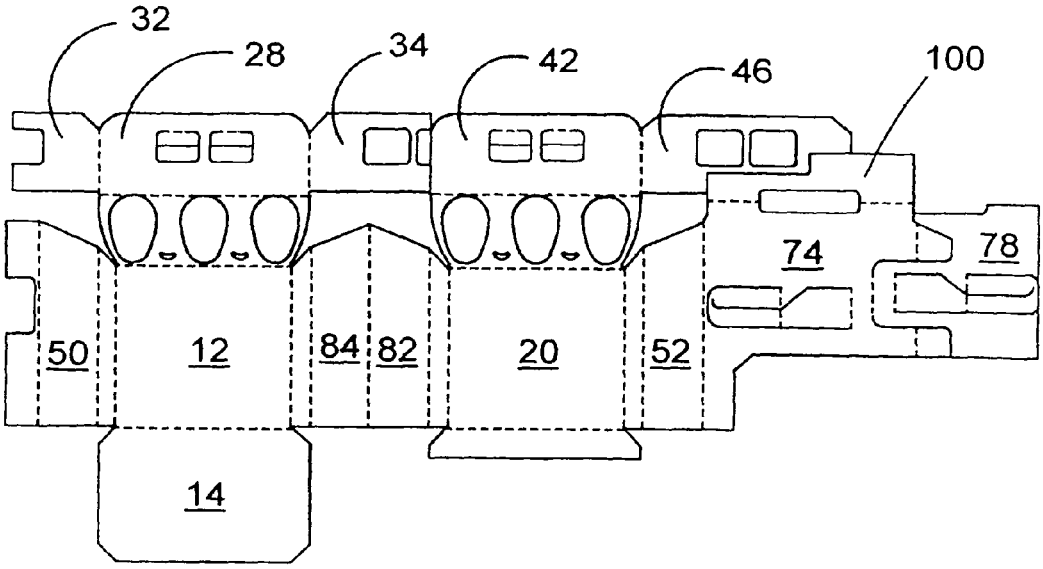
Figure 3:
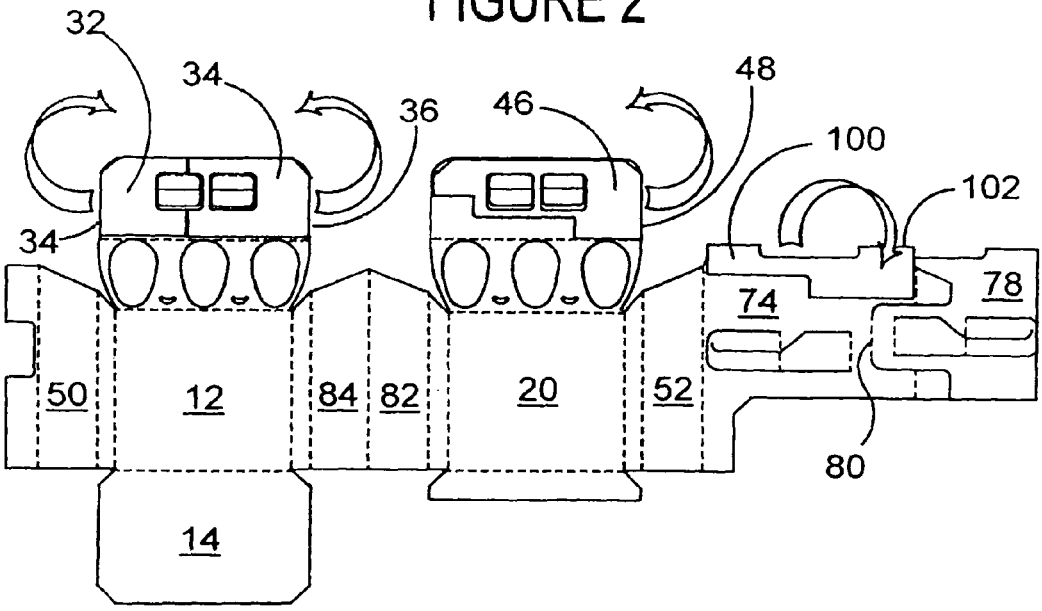
FIGS. 3 to 7 show sequential steps in forming the carrier from the blank of FIGS. 1 and 2.

Referring to the drawings, and particularly to FIGS. 1 and 2 thereof, a bottle carrier "C" is formed from a single blank 10 of paperboard or other suitable foldable sheet material and is adapted to accommodate six bottles "B" (FIG. 9) arranged in two rows of three bottles each. Of course, in other embodiments, the carrier may be formed from two or more blanks and may be adapted to hold a different number of bottles arranged in an alternative array structure, without departing from the scope of invention.

The article carrier comprises a plurality of panels hingedly connected together to form the opposed sides, ends and base. In this embodiment, the carrier comprises a first side wall panel 12 to the lower edge of which is hinged a main base panel 14. Base panel 14 is hinged to side wall panel 12 along fold line 16. To complete the base of the carrier, when the carrier is formed, the free edge of base panel 14 is secured to a base securing strip 18. This is done after the carrier is loaded with bottles. Base strip 18 is hinged to the lower edge of a second opposing side wall panel 20 of the carrier along a fold line 22.

One end of the carrier is provided by end panels 50 and 52 respectively. End panel 50 is hinged along fold line 54 to intermediate panel 56, which provides a beveled corner panel between side panel 12 and end panel 50. Panel 56 is hinged to side panel 12 along fold line 58. A medial panel strip 60 may be provided which is hinged to the opposite end edge of end panel 50 along fold line 66.

Similarly, end panel 52 is hinged along fold line 68 to intermediate panel 70, which provides another beveled corner panel of the carrier between side panel 20 and end panel 52. Panel 70 is hinged to side panel 20 along fold line 72. Along its opposite end edge, panel 52 is hinged to the medial partition structure along fold line 76.

The opposite end of the carrier is provided by end panels 82 and 84 respectively. End panel 82 is hinged along fold line 86 to intermediate panel 88, which provides a beveled corner panel between side panel 20 and end panel 82. Panel 88 is hinged to side panel 20 along fold line 90. Along its opposite edge, panel 82 is hinged along fold line 92 to an adjacent end panel 84. Similarly, end panel 84 is hinged along fold line 94 to intermediate panel 96, which provides a beveled corner panel between side panel 12 and end panel 84. Panel 96 is hinged to side panel 12 along fold line 98.

In other embodiments, the intermediate panels 56, 70, 88, 96 are dispensed with so that the carrier is provided with substantially perpendicular corners.

The medial partition structure is provided by first medial panel 74 hinged to second medial panel 78 along fold line 80 and forms a part of the central internal structure of the carrier beneath the handle structure H. In one class of embodiments the construction of the medial panels 74 and 78 respectively, is as follows:

Medial panel 74 comprising an integral handle means in the form of handle panel portion 74*a* to which is hinged a reinforcing handle panel 100 along fold line 102 which is folded into face to face relationship with panel portion 74*a*. From both these panels is struck hand aperture 104 adjacent the upper edge of the reinforced panel 74. In order to create partitions which, in part, define one row of individual cells of the carrier, a pair of transverse partition panels 81 and 83 are struck from and hinged to the main medial panel 74 along fold lines 87 and 91 respectively. The opposite ends of the transverse partition panels are joined to one another by a common anchoring panel 85 along fold line 89.

One or more securing flaps are provided and hingedly connected to first medial panel 74.

In this embodiment, two securing flaps 114 and 116 are hingedly connected to the outer end edge of main medial panel 74 at spaced locations along fold lines 118 and 120, respectively.

Second medial panel 78 is hinged to medial panel 74 along fold line 80 disposed between but longitudinally (of the blank) displaced from fold lines 118 and 120. By offsetting fold line 80, for example inwardly into first medial panel, enables the second medial panel to be reduced in width, thereby reducing the amount of paperboard required.

In order to create further partitions which, in part, define the other row of individual cells of the carrier, a pair of transverse partition panels 122, 124 are struck from and hinged to the secondary medial panel 78 along fold lines 126 and 128 respectively. The opposite ends of the transverse partition panels are joined to one another by a common anchoring panel 130 along fold line 132.

In one embodiment of the present invention, in order to prevent individual bottles from being removed from the carrier the bottles are restrained by cover panels, which can be detached after the full carrier has been purchased. The cover panels also help to keep the bottles dust free.

A handle structure H (FIG. 9) is provided and includes an integral top panel 24 which covers the bottle receiving cells along one side of the handle structure H but includes a series of openings $S_1$, $S_2$, $S_3$ through which neck portions of bottles accommodated in those cells protrude. Top panel 24 is hinged to side wall panel 12 along a frangible score line 26 and is also integral with and hinged to a handle panel 28 along fold line 30. There may further comprise first and second handle reinforcing flaps 32 and 34 hingedly connected to handle panel 28 along score lines 35 and 36 respectively. Thus, in use, the top panel 24 can be torn away along the frangible score line 26 and detached, at least partially, to allow bottles in the underlying cells to be taken from the carrier. Handle panel 28 may include handle openings HH that is reinforced by hinged handle flaps 32 and 34 with registering openings.

There may further comprise a second integral top panel 38 which covers the bottle receiving cells on the opposite side of the handle structure H and includes a series of openings $S_4$, $S_5$, $S_6$ through which neck portions of bottles accommodated in those cells protrude. Top panel 38 is hinged to side wall panel 20 along a frangible score line 40 and is also integral with and hinged to a second handle panel 42 along score line 44. Thus, in use, the top panel 38 can be torn away along the frangible score line 40 and at least partially detached to allow bottles in the underlying cells to be taken from the carrier. Handle panel 42 includes handle openings HH and is reinforced by a handle flap 46 hinged along fold line 48. Handle openings in handle flap 46 are put into registry with handle openings HH when handle structure H is formed.

In order to form the completed carrier in flat collapsed condition from the blank, a series of sequential folding and gluing operations are required and reference is made to FIGS. 2, 3, 4, 5, 6 and 7. Although some of these operations are known to those skilled in the art, in this particular case, first the handle reinforcing panel 46 is folded about fold line 48 and secured in face to face relationship with handle panel 42. Handle structure 20 reinforcing panels 32 and 34 likewise are folded and secured in face to face relationship with handle panel 28. Likewise reinforcing panel 100 is folded about fold line 102 and secured in face to face relationship with the upper panel portion 74*a* of main medial panel 74 so that the blank is in a part folded condition shown in FIG. 3.

Figure 4:
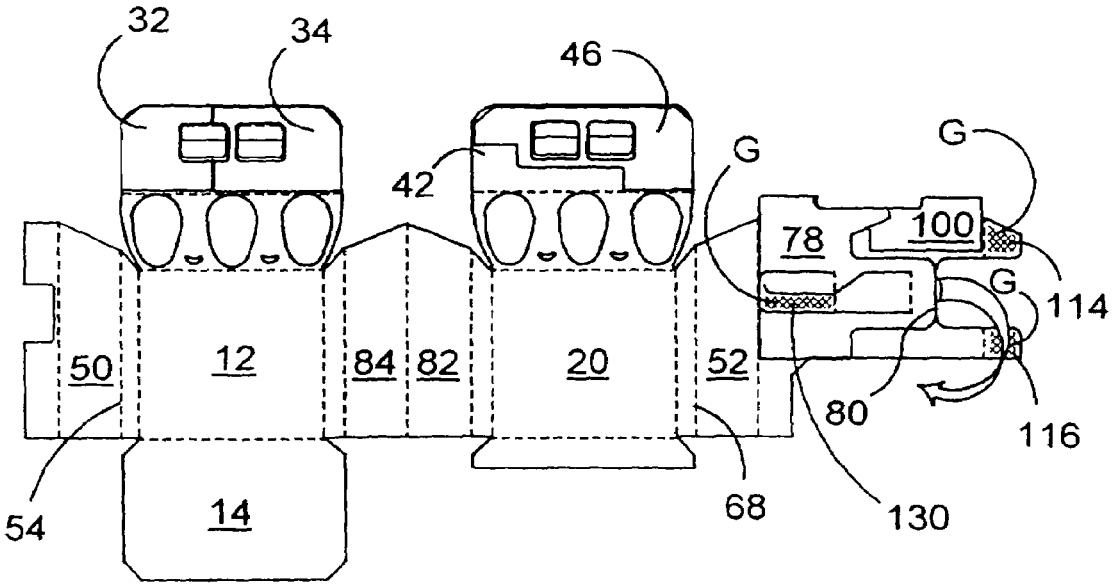
Figure 5:
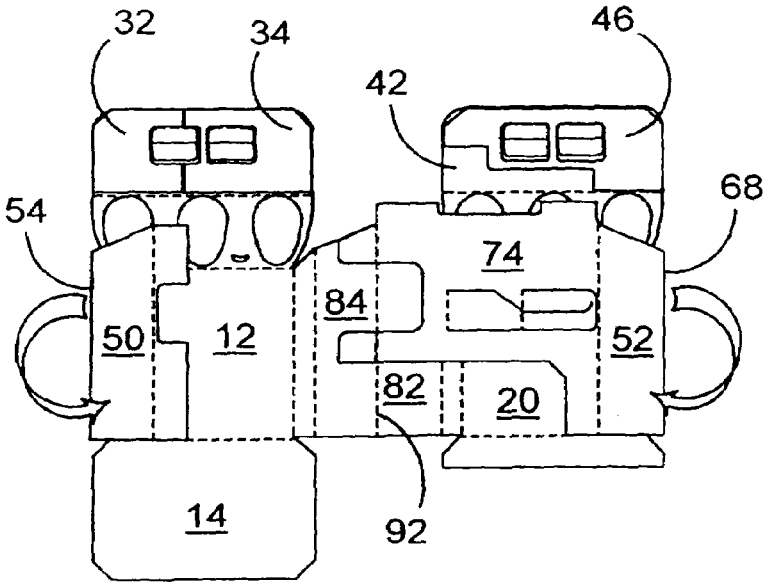

Referring to FIG. 4, second medial panel 78 is folded inwardly about fold line 80 into face to face relationship with medial panel 74 so as to reveal securing flaps 114, 116. The securing flaps are then secured to the end wall panel 82, 84 by glue or other suitable means known in the art. In this embodiment, glue is applied to areas G comprising anchor panel 130 and securing flaps 114 and 116 respectively.

Medial panels 74, 78 are folded inwardly about fold line 68 whereby the common anchoring panel 130 is adhered to side wall panel 20 and anchoring tabs 114, 116 are secured in face to face relationship with end wall panel 84. Similarly, end wall structure 50, 60 is folded inwardly about fold line 54 into face to face relationship with side wall panel 28. The part assembled blank is in the form shown in FIG. 5.

Figure 6:
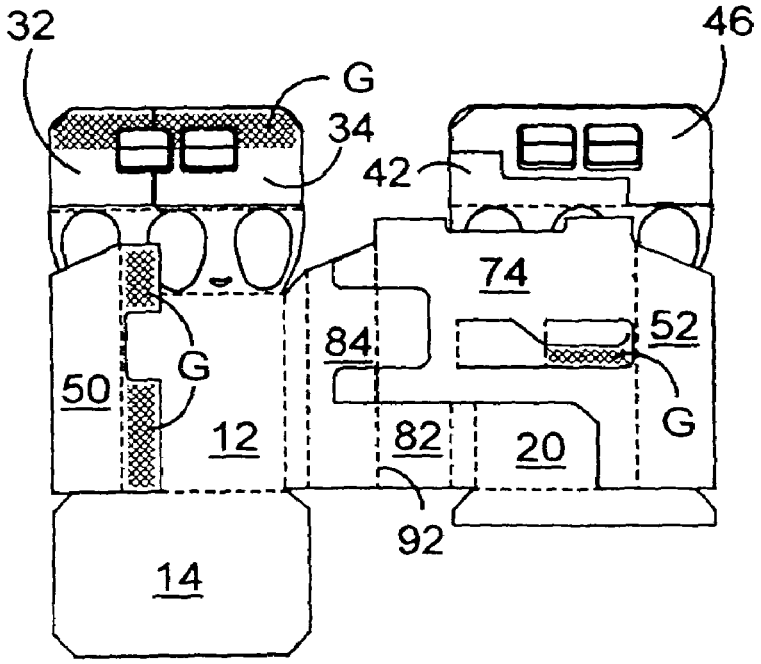
Figure 7:
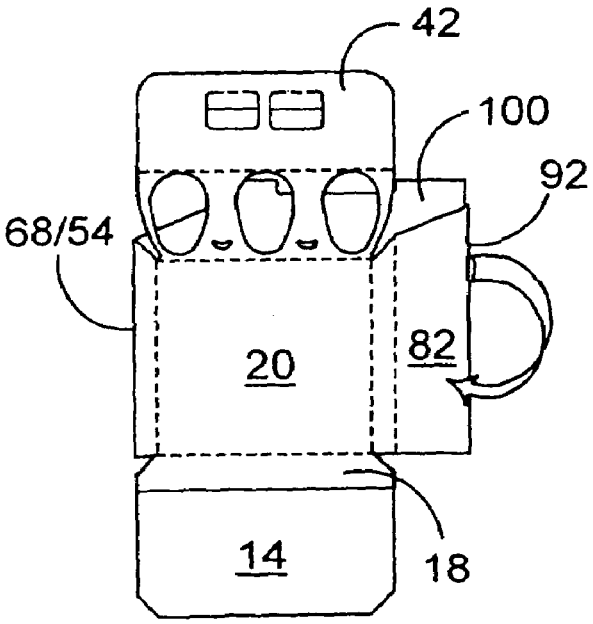

The opposing ends of the blank are secured together. Referring to FIG. 6, glue is then applied to areas G comprising the upper parts of reinforcing panels 32, 34; the medial panel strip 60 and the anchoring panel 130. Thereafter, as shown in FIG. 7, the partially formed carrier is folded about the now central fold line 92 to bring those parts on either side of the central fold line 92 into face to face relationship whereby anchor panel 130 is adhered to side wall panel 12; handle reinforcing panels 46, 32, 34 are adhered together and medial panel strip 60 is adhered to the exposed face of end wall panel 52. The carrier is then in a flat collapsed form from which it can be erected for loading.

Figure 8:
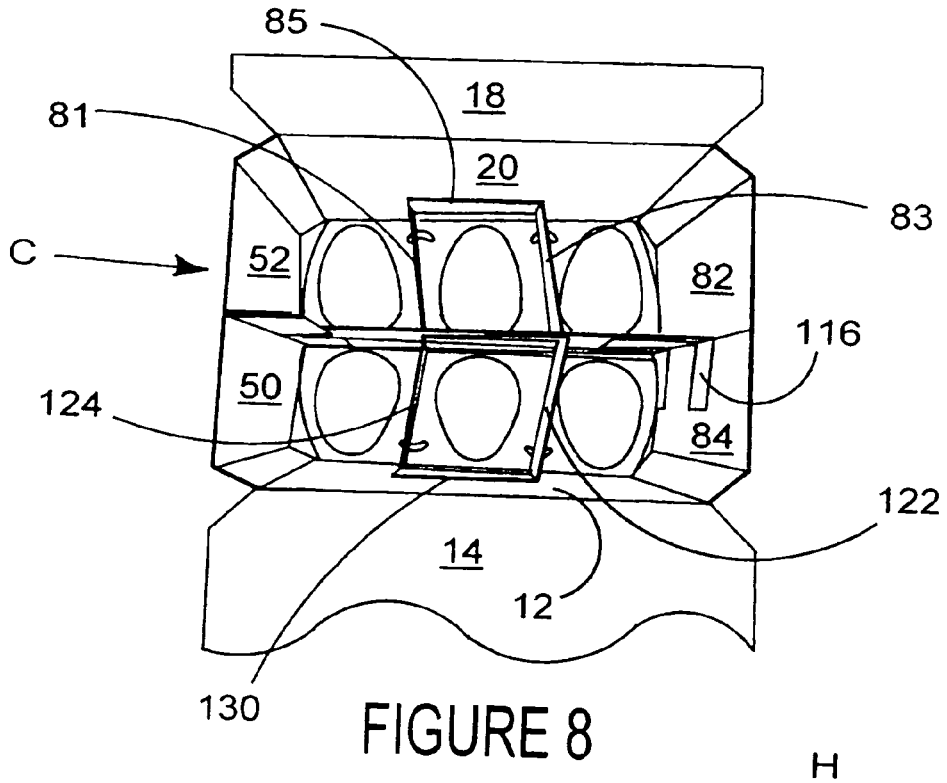
FIG. 8 shows the completed and erect carrier from below prior to loading.
Figure 9:
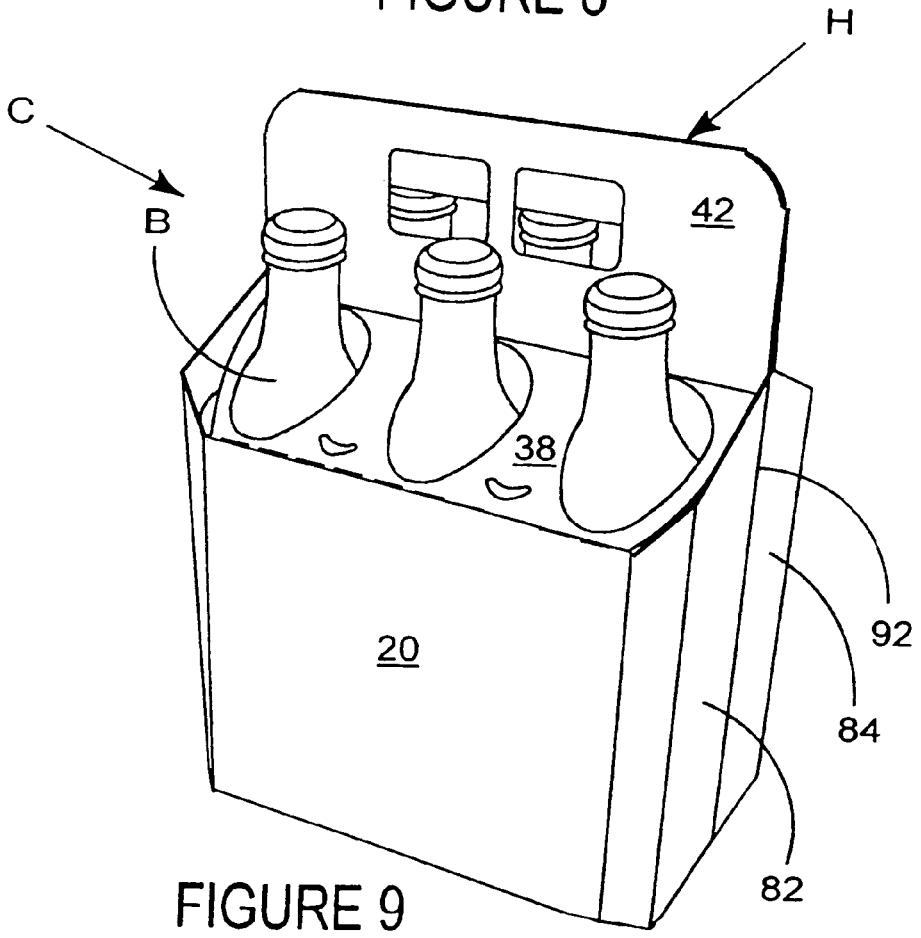
FIG. 9 shows the completed and loaded carrier.
Figure 10:
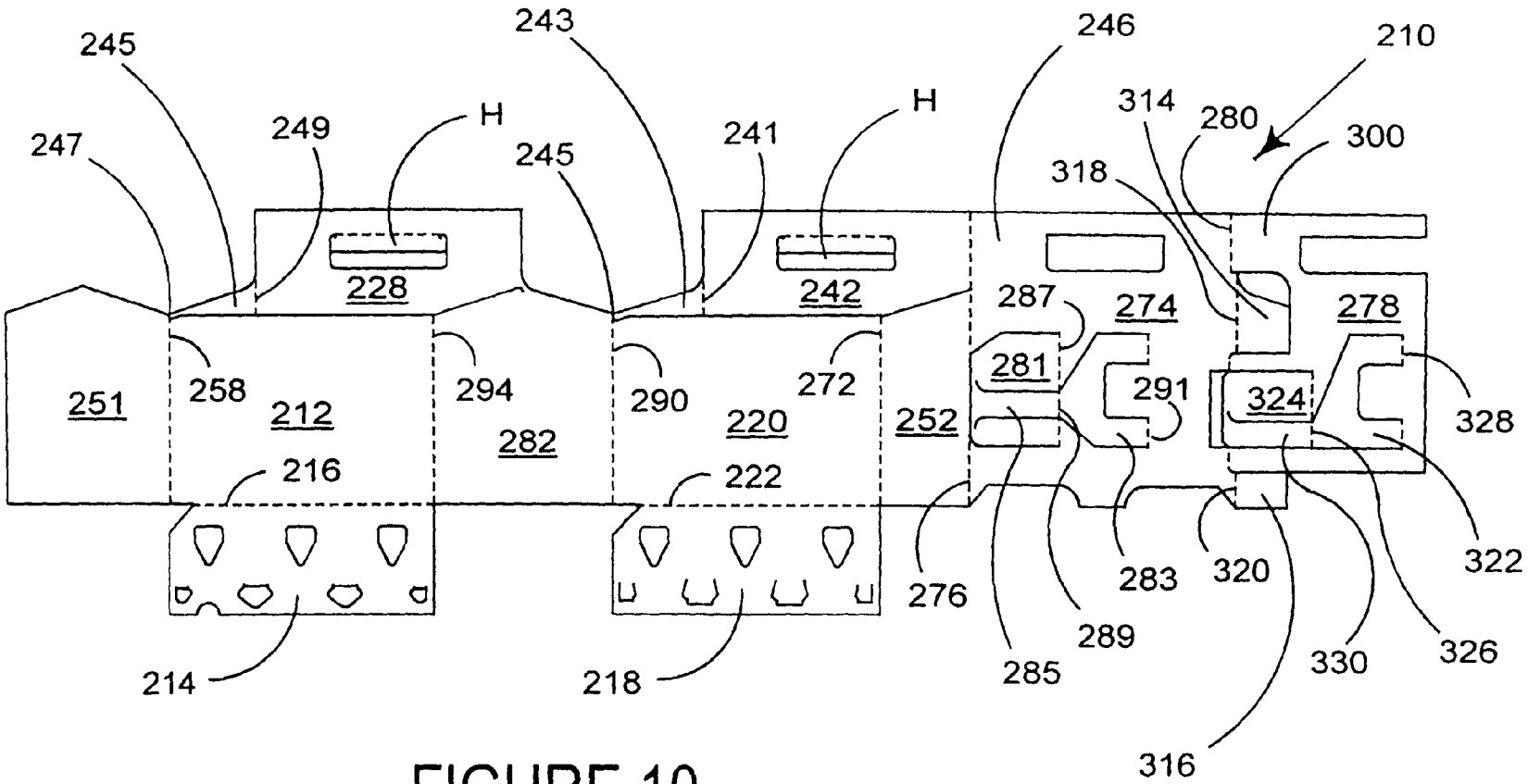
FIGS. 10 and 11 are plan views of an unfolded single blank of paperboard from which another carrier according to another embodiment of the invention is formed.

Loading is accomplished by relative vertical movement between bottles and carrier during common forward feed movement, well known in the art, by which the carrier is erected by separating the opposed sides and ends, as shown in FIG. 8 and the bottles enter their respective cells and through apertures $S_1$, $S_2$, $S_3$ $S_4$, $S_5$ and $S_6$ through the open bottom of the carrier. Thereafter, the bottom panel 14 is folded upwards to close the lower ends of the bottle cells and the free edge of bottom panel 14 is secured in overlapping relationship with the free edge of securing strip 18 to form the base of the carrier and hence the loaded carrier is complete, as illustrated in FIG. 9.

In order to gain access to the contents of the carrier C, the top panels 24 and 38 may be removed by tearing along the frangible fold lines 26 and 40 in order to expose the bottles. However, this action does not destroy the overall integrity of the carrier so that empty bottles can be returned in the carrier to a point of sale. Optionally, the upper part 74*a* of the medial partition structure serves as a handle.

The basket type carrier shown with reference to FIGS. 10 to 18 is of similar construction to the carrier described above, except in the following substantive respects, and like parts thereof are designated like reference numerals with the addition of the prefix '2' (or as the case may be '3' instead of the first numeral '1') in FIGS. 1 to 9. Only the differences will be described in any greater detail.

Base panels 214 and 218 incorporate known locking means and because of the absence of upper panels 24, 38 (of the previous embodiment) the carrier of FIGS. 10 to 18 is loaded from above after the base panels 214 and 218 have been overlapped and locked together. The only other significant differences apart from dimensional changes are that the handle structure has no reinforcing panels such as panels 32, 34 and 46 of the previous embodiment and there are no top cover panels (such as panels 24, 38) to close the top of the carrier.

The medial partition structure is similar to the first embodiment and is provided with medial panel 274 comprising an integral handle panel portion 246 to which is hinged a reinforcing handle panel 242 along fold line 276 which is folded into face to face relationship with panel portion 246. From both these panels is struck hand aperture adjacent the upper edge of the reinforced panel 274. In order to create partitions which, in part, define one row of individual cells of the carrier, a pair of transverse partition panels 281 and 283 are struck from and hinged to the main medial panel 274 along fold lines 287 and 291 respectively. The opposite ends of the transverse partition panels are joined to one another by a common anchoring panel 285 along fold line 289.

One or more securing flaps are provided and hingedly connected to first medial panel 274. In this embodiment, two securing flaps 314 and 316 are hingedly connected to the outer end edge of main medial panel 274 at spaced locations along fold lines 318 and 320, respectively.

Second medial panel 278 is hinged to medial panel 274 along fold line 280 disposed between but longitudinally (of the blank) displaced from fold lines 318 and 320. By offsetting fold line 280, for example inwardly into first medial panel, enables the second medial panel to be reduced in width, thereby reducing the amount of paperboard required.

In order to create further partitions which, in part, define the other row of individual cells of the carrier, a pair of transverse partition panels 322, 324 are struck from and hinged to the secondary medial panel 278 along fold lines 326 and 328 respectively. The opposite ends of the transverse partition panels are joined to one another by a common anchoring panel 330 along fold line 332.

Figure 11:
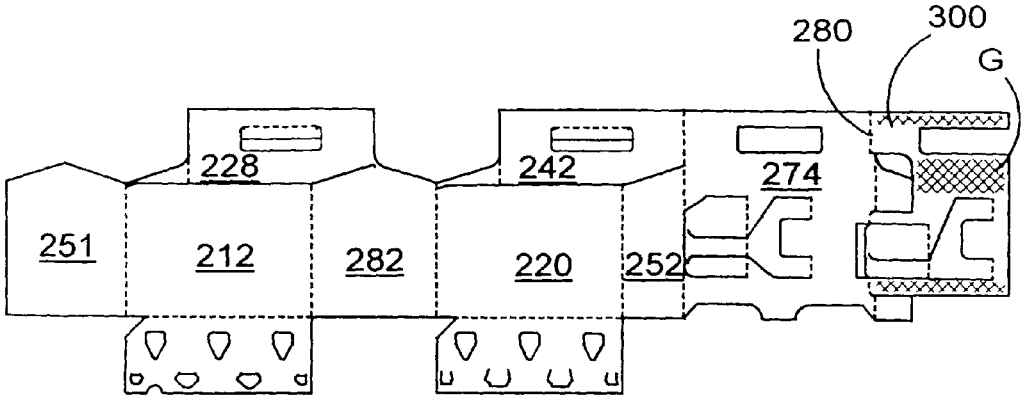
Figure 12:
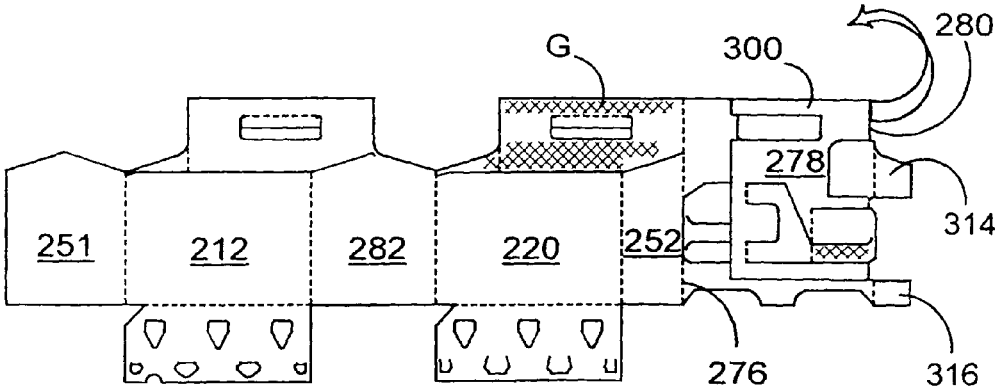
FIGS. 12 to 16 show sequential step in forming the carrier from the blank of FIGS. 10 and 11.

The carrier is constructed in like manner to the first embodiment, whereby the second medial panel 278 is folded inwardly and is secured to the first medial panel 274 by glue or other suitable means known in the art as shown in FIGS. 11 and 12 to reveal securing flaps 314 and 316.

Figure 13:
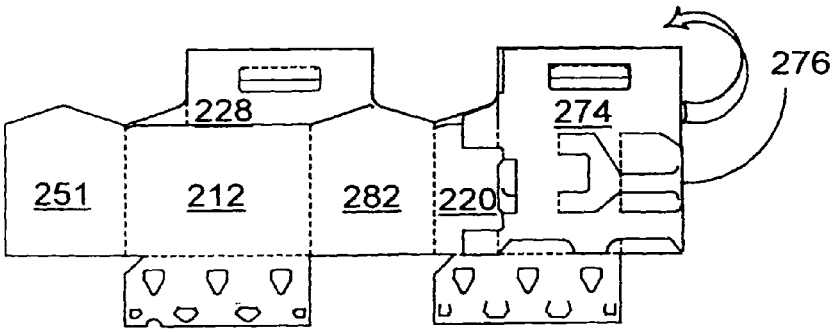

Thereafter, medial partition structure is folded inwardly along fold line 276 to be placed in face contacting arrangement with side wall panel 220 and handle panel 242 and is secured thereto, in like manner to the first embodiment and shown in FIG. 13.

Figure 14:
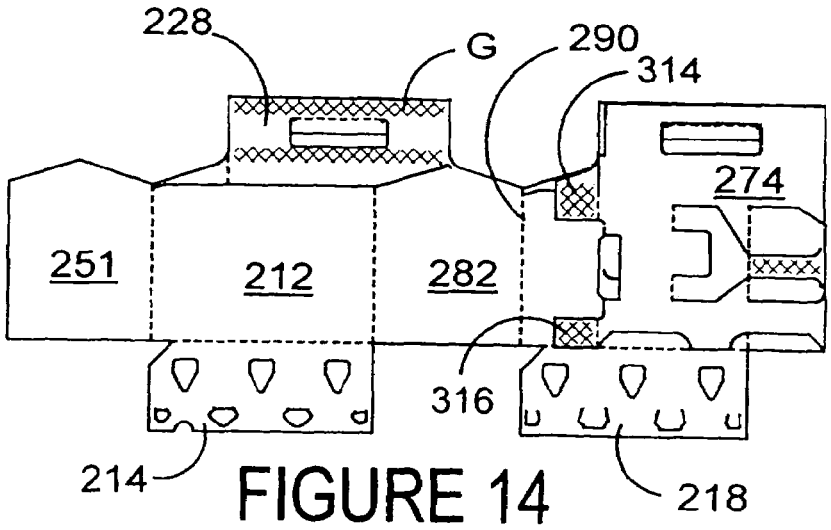
Figure 15:
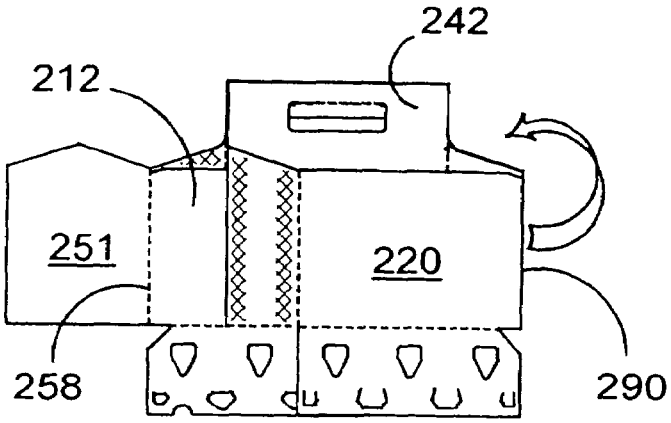
Figure 16:
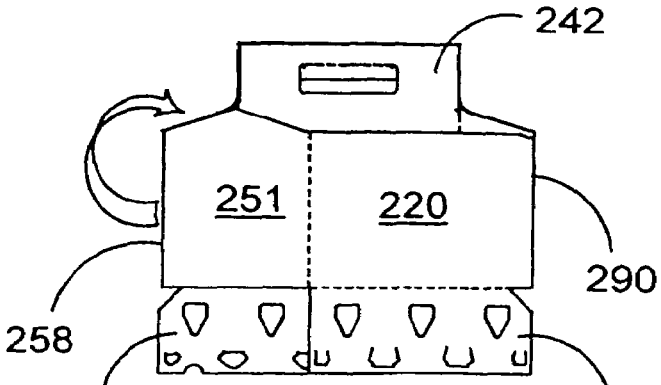

Thereafter, the sides and ends of the article carrier are constructed whereby securing flaps 314, 316 are secured to end wall panel 282 shown in FIGS. 14 and 15. End wall panel 252 is secured to end wall panel 251 as shown in FIG. 16, so that the carrier is in a flat collapsed condition, ready to be supplied to an end user.

Figure 17:
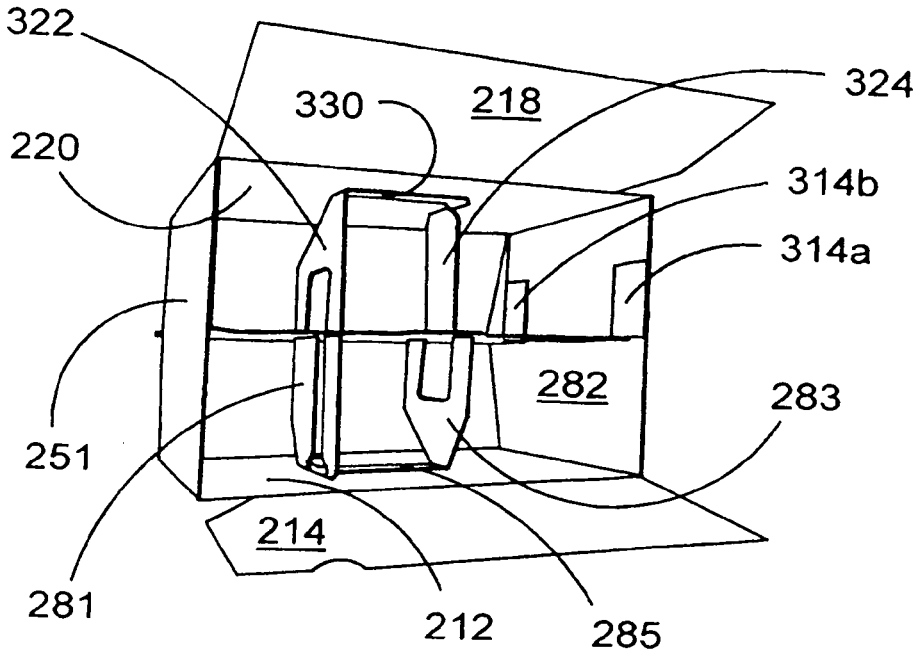
FIG. 17 shows the completed carrier of blank of FIG. 10 from below before the base panels are closed and locked together.
Figure 18:
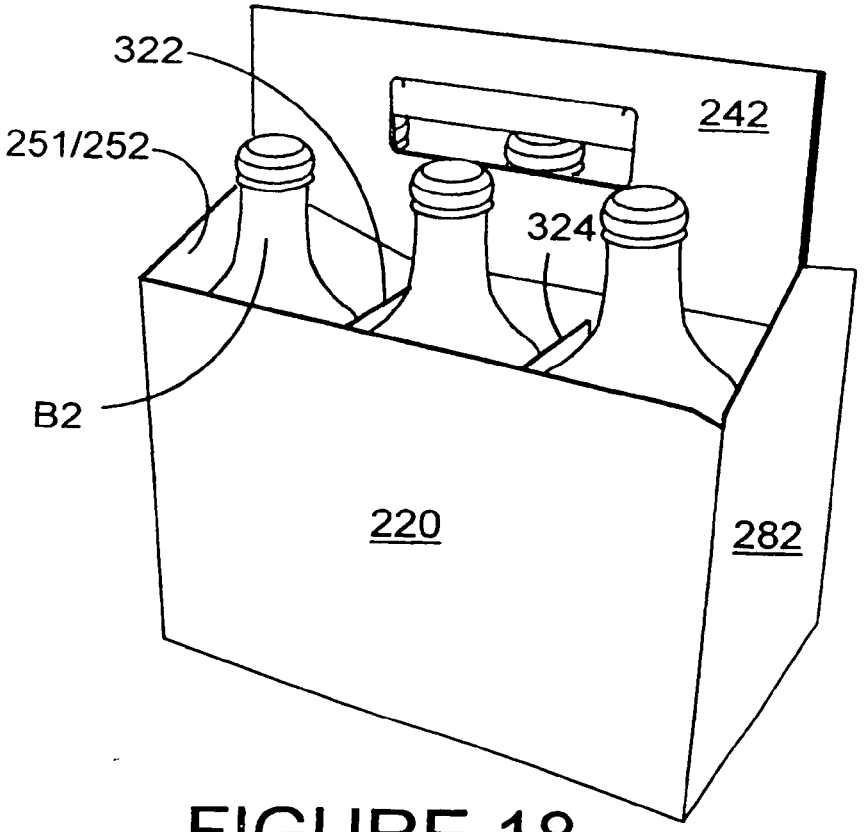
FIG. 18 shows the completed and loaded carrier formed from the blank of FIG. 10.

To complete construction of the carrier shown in FIGS. 17 and 18, the sides and ends are separated, articles loaded into the carrier and the base wall is formed.

Figure 19:
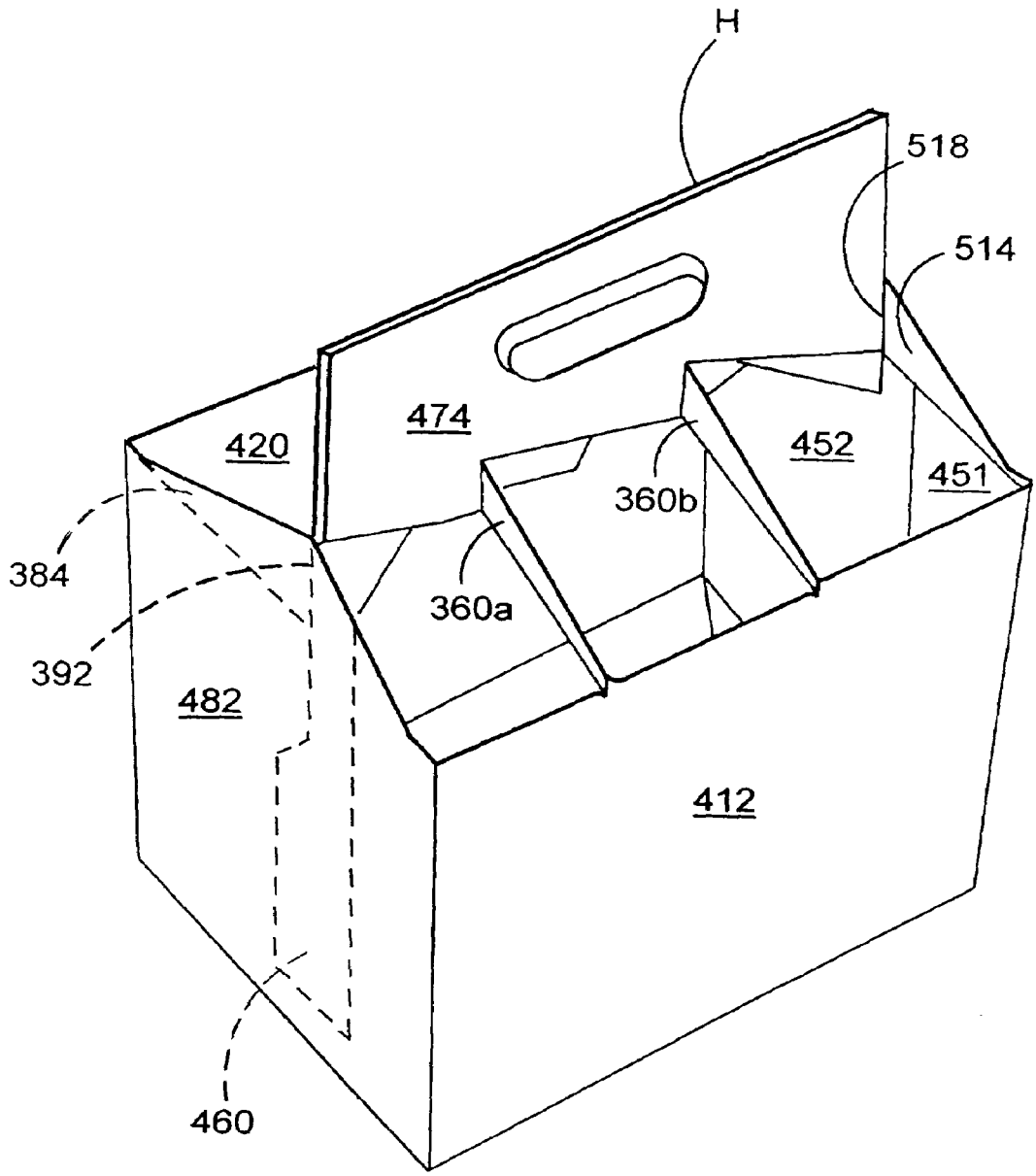
FIG. 19 illustrates a carrier formed from a blank according to a third embodiment of the invention.
Figure 20:
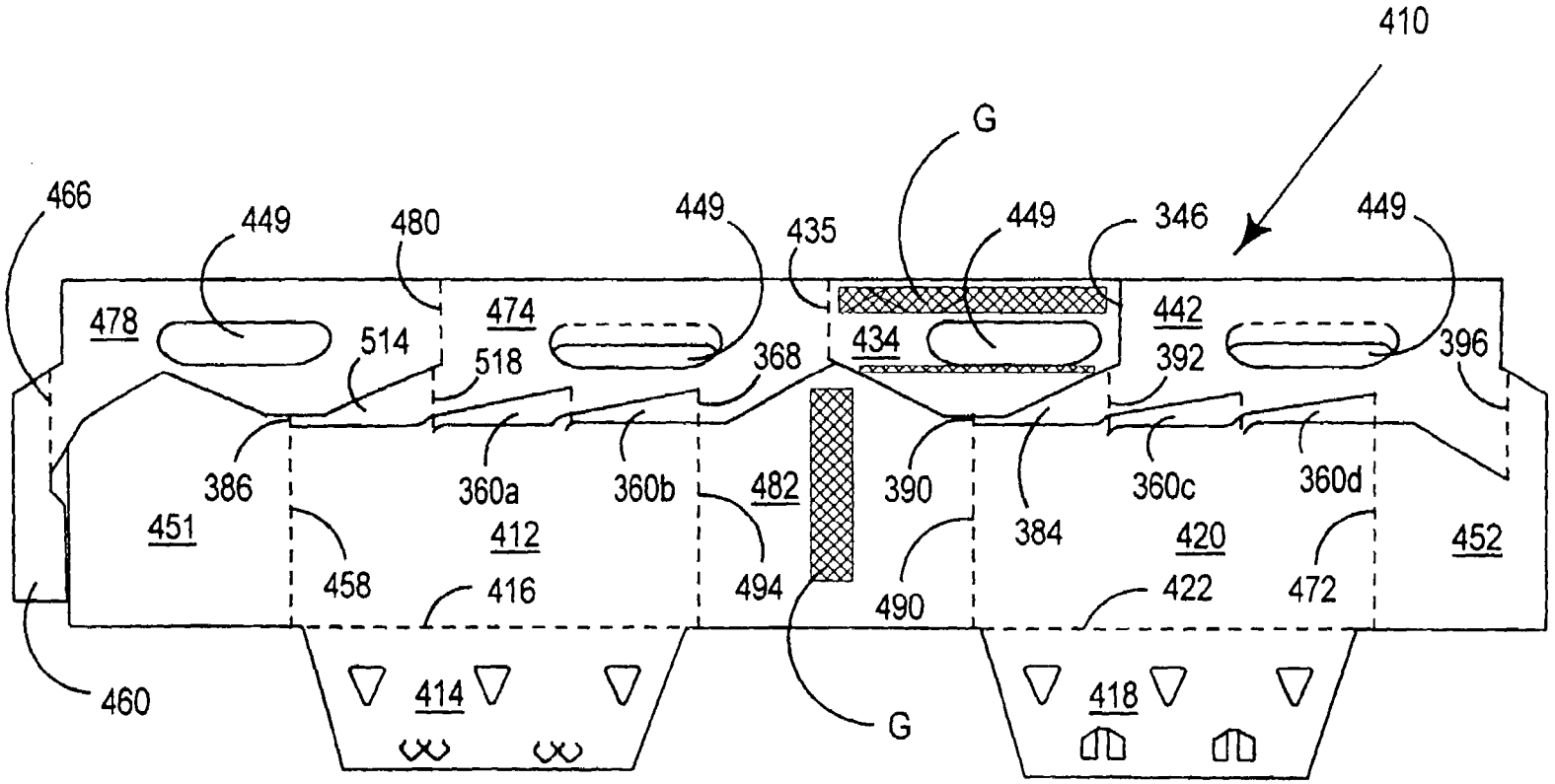
FIG. 20 illustrates the blank for forming the carrier shown in FIG. 19.
Figure 21:
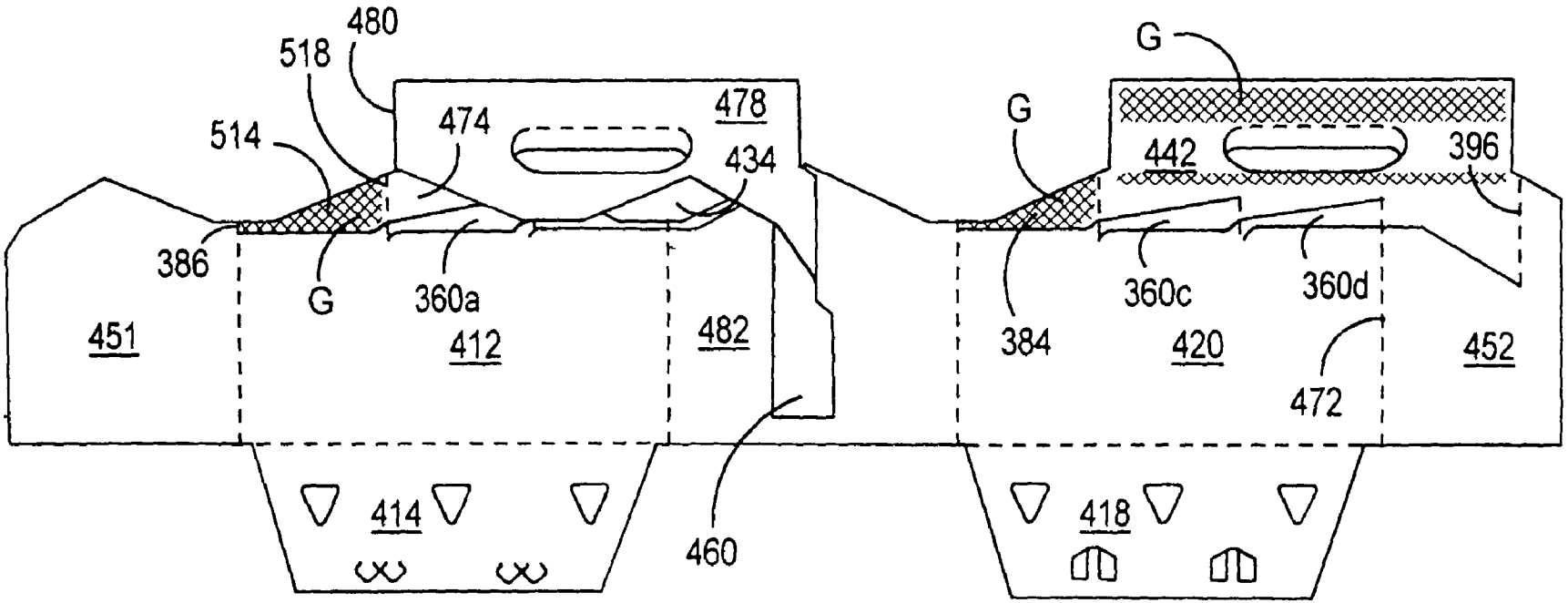
FIG. 21 illustrates the initial forming stage of the carton from the blank of FIG. 20.

A third embodiment is illustrated in FIGS. 19 to 21. The third embodiment is similar to the first and second embodiments so like references have been used with the prefix "4" or, as the case may be, "5" instead of the first numeral '2' or '3' in FIGS. 10 to 18.

Referring to FIG. 19, the present invention provides a basket-style article carrier for carrying articles such as beverage bottles. The carrier 410 (FIG. 20) is preferably formed from paperboard. However, it may be formed from any other foldable sheet material such as corrugated board, a plastic sheet or the like. The carrier has a pair of first and second side walls 412 and 420 that are arranged in a substantially parallel relationship. A pair of substantially parallel first and second end walls 451 and 482 interconnect the side walls 412 and 420 to form a vertical tubular structure.

A composite handle structure (or medial partition structure) H is located generally at the top end of the tubular structure to span the end between the first and second end walls 451 and 482. The handle structure H is arranged parallel to the side walls 412 and 420 at a location equidistant from the side walls. The longitudinal axis of the handle structure H lie perpendicular to the end walls 482 and 451 while the handle structure H is connected at its opposite ends to the end walls through strengthened joints that will be described later in detail.

FIG. 20 illustrates a blank from which the carrier is formed and includes in the described sequence a first end wall panel 451, a first side wall panel 412, a second end wall panel 482 and a second side wall panel 452. These panels 451, 412, 482 and 420 are hingedly connected together one to the next along fold lines 458, 494 and 490 respectively to form, when the blank is erected, a tubular structure.

The handle structure comprises first and second medial panels 474 and 478 hingedly connected together along fold line 480. In this embodiment, the first and second medial panels 474 and 478 are provided with hand apertures 449, respectively. The first medial panel 474 is hingedly connected to first side wall panel 412 by means of partition straps 360*a*, 360*b* and securing strap 514, but is otherwise separated therefrom.

The handle structure H further comprises a third medial panel for 442 connected to a second side wall panel 420 by means of second pair of partition straps 360*c* and 360*d* and a securing flap 384 but is otherwise separated therefrom. Similarly, a hand aperture 449 is provided in third medial panel 442. The handle structure H further comprises a handle support panel 434 that is separated from the third medial panel 442 by cut line 346.

Turning to the construction of the partition straps in more detail, the first partition straps 360*a* and 360*b* are formed from the blank between the first medial panel 474 and the first side wall panel 412 and are hingedly connected to the first side wall panel 412 and to the first medial panel 474. Otherwise, the partition straps 360 and 360*b* are severed from the blank.

In like manner, the second partition straps 360*a* and 360*d* are formed from the blank between the handle panel 442 and the second side wall panel 420. The partition straps 360*a* and 360*d* are hingedly connected to the second side wall panel 420 and to handle panel 442. The other part of the partition straps are severed from of the blank.

The first securing strap 514 is formed from the blank between the second medial panel 474 and the first side wall panel 412. The first securing strap 514 is hingedly connected to the first end wall panel 451 along a fold line 386 and to the first medial panel 474 along a fold line 518. Otherwise, the first securing strap 514 is severed from the blank. The fold line 518 is displaced from the fold line 480 connecting first medial panel 474 and second medial panel 478, so as to reduce the amount of paperboard required.

The second securing strap 384 is formed from the blank between the third medial panel 442 and the second side wall panel 420. The securing strap 384 is hingedly connected to the second end wall panel 420 along a fold line 390 and to the third medial panel 442 along a fold line 392. The other part of the second securing strap 384 is severed from the blank.

The respective right-hand ends, as viewed in FIG. 20, of the medial panel 442 and side wall panels 420 are interconnected by a joint-reinforcing panel 452. A part of the reinforcing panel 452 is located under the portion of the medial panel 442.

Further, a joint-reinforcing flap 460 is provided next to the left-hand ends, as viewed in FIG. 20. The reinforcing flap 460 is hingedly connected to the second medial panel 478 along a fold line 466. Otherwise, it is separated from the blank.

First and second bottom lap panels 414 and 418 are hingedly connected to the first and second side wall panels 412 and 420 along fold lines 416 and 422 respectively. These bottom panels 414 and 418 are sized, tapered, and spaced from each other to create open spaces adjacent these panels 414 and 418 so that bottom panels of an another like carrier blank are allowed to be nestably received in the open spaces when the blanks are cut from a web of paperboard. This arrangement minimizes the amount of paperboard scrap. The bottom panels 414 and 418 are sized to overlap each other in an erected carrier and are provided with known locking means, such as a tab-and-aperture lock, for securing themselves together.

To erect the carrier of FIG. 19 from the blank of FIG. 20, the handle support panel 434 is applied with glue as indicated by stippling in FIG. 20 and is folded inwardly about the fold line 435. This causes the handle support panel 434 to be secured to the first medial panel 474 in a face-to-face contacting relationship. The joint-reinforcing flap 460 is folded about the fold line 466. Glue is then applied to the second medial panel 478 as well as to the reinforcing flap 460, and the second medial panel 478 and the reinforcing flap 460 are swung 180 degrees about the fold line 480 to the position shown in FIG. 21. As a result, the second medial panel 478 is secured to the first medial panel 474 and handle support panels 434 while the reinforcing flap 460 is adhered to the inside surface of the second end wall panel 482.

The next step for the assembling is the application of glue to the securing straps 514 and 384 and to the third medial panel 442. After the glue application, the parts of the blank on the right-hand side of the fold line 490 as viewed in FIG. 20 is folded as a unit toward the left about the fold line 490. At this step, the second securing strap 384 is affixed to the inside surface of the second end wall panel 482, and the third medial panel 442 is secured to the second medial panel 478 to complete the handle structure H (FIG. 19) of a four-ply composite construction. At the same step, a part of the first securing strap 514 is adhered to the inside surface of the reinforcing pane 4521. Glue is then applied to the first end wall 451 and the first end wall 451 is folded about the fold line 458 onto the reinforcing panel 452. At this step, the first end wall is secured to the reinforcing panel 452 and a part of the first securing strap 514 is adhered to the inside surface of the first end wall 451.

The carrier thus formed wherein the carrier is in a flat collapsed condition and may be shipped to the bottling plant in this condition. At the bottling plant, the carrier is opened so that the side and end wall panels create the tubular structure and thereby the handle structure H becomes spaced from and parallel to the side wall panels. The opening of the flat carrier also causes the first and second partition straps 360 to fold about their fold lines and to take the respective positions where each partition strap extends transversely of the handle structure H as shown in FIG. 19.

The bottom of the carrier may be closed before or after the carrier is loaded with articles in like manner to the earlier embodiments. Articles may be drop-loaded into the carrier thereafter. Otherwise, articles may be loaded before the bottom is closed. To do so, the carrier is applied to a group of articles from above the articles.

Referring again to FIG. 19, the carrier in an erected form has a seamless, symmetrical end wall 482 opposed to a seamed symmetrical end wall that is made up of the end wall panel 451 and the reinforcing panel 452. The end wall 482 is connected to an end of the handle structure H by a joint created by the securing strap 384 that has been glued to the inside surface of the end wall 482. The end wall 451 is connected to the other end of the handle structure H through a joint created by the securing strap 514 that has been glued to the inside surface of the end wall 451. These joints are reinforced by the joint-reinforcing members 460 and 452.

The present invention and its preferred embodiment relates to an arrangement for providing a more economical basket carrier. However, it is anticipated that the invention can be applied to a variety of carriers and is not limited to those of the basket style hereinbefore described and could be used for numerous applications for example a wraparound carton or fully enclosed carton.

It will be recognized that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate more than one article in different arrays.

What is claimed is:

1. An article carrier of the basket type adapted to accommodate a plurality of articles, comprising a base, opposed side walls and opposed end walls, a handle structure and a medial partition structure extending between said end walls and disposed at least in part below said handle structure, said articles being receivable on both sides of said medial partition structure, wherein a securing flap is hinged to said medial partition structure and is secured to one of said end walls to create a joint between said medial partition structure and said one end wall, wherein said medial partition structure comprises first and second medial panels hinged together along a first fold line, said first and second medial panels are disposed in face to face relationship with each other, and wherein the first fold line is disposed inwardly of the carrier from said one end wall relative to a second fold line by which said securing flap is hinged to one of said first and second medial panels.

2. The article carrier according to claim 1 wherein said first fold line is disposed between opposed end edges of said one medial panel, and said second fold line is disposed along one of the opposed end edges of said one medial panel.

3. The article carrier according to claim 2 wherein said first and second fold lines are disposed in parallel with each other.

4. The article carrier according to claim 1 wherein said first and second medial panels each provides a transverse partition strip for connecting the medial partition structure to said side walls.

5. The article carrier according to claim 1 wherein said securing flap is hinged to said one medial panel.

6. The article carrier according to claim 1 wherein said first medial panel is a full length panel extending between said opposed end walls, and said second medial panel is shorter in length than said first medial panel.

7. The article carrier according to claim 1 wherein said medial partition structure is attached to said handle structure and extends downwardly from the handle structure.

8. A blank for forming an article carrier of a basket type, said blank comprises a series of main panels hinged one to next for forming opposed side walls, opposed end walls, a base and a medial partition structure when said carrier is erected, wherein said blank includes at one end thereof first and second medial panels for forming said medial partition structure, wherein a first transverse partition member is formed from said first medial panel to be secured to one of said side walls, a securing flap is hinged to one of opposed end edges of said first medial panel, a second transverse partition member is formed from said second medial panel to be secured to the other side wall, said first and second medial panels are hinged together along a first fold line, and said first fold line is disposed between said opposed end edges of said first medial panel, said one end edge of said first medial panel is disposed along a second fold line by which said securing flap is hinged to said first medial panel.

9. The blank according to claim 8 wherein said medial partition structure comprises handle means by which said carrier can be lifted and carried.

10. The blank according to claim 8 wherein the first and second fold lines are disposed in parallel with each other.

11. The blank according to claim 8 wherein said first and second transverse partition members each comprises a transverse partition strip for connecting said medial partition structure to a respective one of said side walls.

12. The blank according to claim 8 wherein said first medial panel is a full length panel adapted to extend between said end walls, and said second medial panel is shorter in length than said first medial panel.

13. An article carrier of the basket type adapted to accommodate a plurality of articles, comprising a base, opposed side walls and opposed end walls, a handle structure and a medial partition structure extending between said end walls and disposed at least in part below said handle structure, said articles being receivable on both sides of said medial partition structure, wherein a securing flap is hinged to said medial partition structure and is secured to one of said end walls to create a joint between said medial partition structure and said one end wall, wherein said medial partition structure comprises first and second medial panels hinged together along a first fold line, wherein the first fold line is disposed inwardly of the carrier from said one end wall relative to a second fold line by which said securing flap is hinged to one of said first and second medial panels, wherein said first fold line is disposed between opposed end edges of said one medial panel, and said second fold line is disposed along one of the opposed end edges of said one medial panel.

14. The article carrier according to claim 13 wherein said first and second fold lines are disposed in parallel with each other.

15. The article carrier according to claim 13 wherein said first and second medial panels each provides a transverse partition strip for connecting the medial partition structure to said side walls.

16. The article carrier according to claim 13 wherein said securing flap is hinged to said one medial panel.

17. The article carrier according to claim 13 wherein said first medial panel is a full length panel extending between said opposed end walls, and said second medial panel is shorter in length than said first medial panel.

18. The article carrier according to claim 13 wherein said medial partition structure is attached to said handle structure and extends downwardly from the handle structure.

* * * * *